US009810013B2

(12) United States Patent
Van Mill et al.

(10) Patent No.: US 9,810,013 B2
(45) Date of Patent: Nov. 7, 2017

(54) DUAL DOOR CONTROL FOR FARM IMPLEMENT

(71) Applicant: Unverferth Manufacturing Company, Inc., Kalida, OH (US)

(72) Inventors: Michael D. Van Mill, Shell Rock, IA (US); Ronald J. Schlimgen, Shell Rock, IA (US); Daryl Rubner, Fairbanks, IA (US)

(73) Assignee: Unverferth Manufacturing Company, Inc., Kalida, OH (US)

( * ) Notice: Subject to any disclaimer, the term of this patent is extended or adjusted under 35 U.S.C. 154(b) by 259 days.

(21) Appl. No.: 14/213,184

(22) Filed: Mar. 14, 2014

(65) Prior Publication Data

US 2014/0311033 A1 Oct. 23, 2014

Related U.S. Application Data

(63) Continuation-in-part of application No. 13/828,578, filed on Mar. 14, 2013, now Pat. No. 9,487,990.

(60) Provisional application No. 61/799,549, filed on Mar. 15, 2013, provisional application No. 61/733,364, filed on Dec. 4, 2012.

(51) Int. Cl.

| | |
|---|---|
| ***B61D 19/00*** | (2006.01) |
| ***E05F 11/42*** | (2006.01) |
| *E05F 11/44* | (2006.01) |
| *B65D 19/00* | (2006.01) |
| *E05F 11/00* | (2006.01) |
| *E05F 11/10* | (2006.01) |
| *E05F 11/54* | (2006.01) |

(52) U.S. Cl.

CPC ..... *E05F 11/42* (2013.01); *B65D 19/002* (2013.01); *E05F 11/00* (2013.01); *E05F 11/10* (2013.01); *E05F 11/44* (2013.01); *E05F 11/54* (2013.01); *E05Y 2201/68* (2013.01); *E05Y 2900/11* (2013.01); *E05Y 2900/132* (2013.01)

(58) Field of Classification Search

CPC . E05F 11/42; E05F 11/44; E05F 11/54; E05F 11/00; E05F 11/10; E05Y 2201/68; E05Y 2900/11; E05Y 2900/132; B65D 19/002

USPC ..... 220/211, 262; 49/350, 353, 170, 279, 49/168, 207; 222/185.1, 505; 232/44

See application file for complete search history.

(56) References Cited

U.S. PATENT DOCUMENTS

| | | | | |
|---|---|---|---|---|
| 624,316 | A * | 5/1899 | Fink et al. | B61D 19/002 49/170 |
| 1,658,641 | A * | 2/1928 | Ilieff | B61D 19/002 49/168 |
| 1,850,091 | A | 3/1932 | Bailey | |
| 3,554,576 | A * | 1/1971 | Parker | B62D 63/06 267/292 |

(Continued)

*Primary Examiner* — Fenn C Mathew
*Assistant Examiner* — Elizabeth Volz
(74) *Attorney, Agent, or Firm* — Rothwell, Figg, Ernst & Manbeck, P.C.

(57) ABSTRACT

A door control system for a farm implement with a storage bin having a discharge opening and a door movable by a drive mechanism between open and closed positions relative to the discharge opening includes a dual position door control system. The system includes at least two controllers at spaced positions relative to the door and coupled to a drive mechanism for opening and closing the door.

17 Claims, 8 Drawing Sheets

(56) References Cited

U.S. PATENT DOCUMENTS 5,842,619 A 12/1998 Cousino

* cited by examiner

DUAL DOOR CONTROL FOR FARM IMPLEMENT

CROSS-REFERENCE TO RELATED APPLICATION

This application claims the benefit of U.S. Provisional Application Ser. No. 61/799,549, filed on Mar. 15, 2013, and is a continuation-in-part of U.S. application Ser. No. 13/828,578, filed on Mar. 14, 2013, which claimed the benefit of U.S. Provisional Patent Application Ser. No. 61/733,364, filed on Dec. 4, 2012, the entire disclosures of which are incorporated herein in their entirety.

BACKGROUND OF THE INVENTION

Field of the Invention

The present invention relates generally to a gate or door control mechanism for a farm implement and, more particularly, to a gate or door mechanism which may be operated from at least two different positions in relation to the gate or door.

Description of the Related Art

Farm implements with storage bins, such as seed tenders, grain wagons, gravity wagons, and the like, typically have a discharge opening with a gate or door movable between an open position exposing the discharge opening and a closed position covering the discharge opening. In such implements, a control mechanism is generally provided to move the gate between open and closed positions. These control mechanisms are generally configured to be operated from a single position in relation to the gate, e.g., to the right or left side of the gate. The positional bias of the mechanism for controlling the gate can be an inconvenience for users operating the grain cart, particularly when material is being discharged from an open gate and the user wants to close the gate, but finds themselves positioned on the wrong side of the control mechanism.

SUMMARY OF THE INVENTION

In accordance with an aspect of the present invention, a door control system for a farm implement with a storage bin having a discharge opening and a door movable between open and closed positions relative to the discharge opening includes a base having first and second ends. The base is configured for mounting on the farm implement in relation to the door. The door control system also includes at least two door control assemblies mounted on the base and configured to move the door between open and closed positions. Each door control assembly includes a controller coupled to the base and movable in relation thereto and a drive mechanism coupled with the controller configured to move the door between the open position and the closed position in response to movement of the controller.

In an embodiment of the present invention, each of the controllers includes a hand wheel.

In an embodiment of the present invention, each of the drive mechanisms includes a first shaft, a first gear, a second shaft, a second gear, a third gear, a third shaft, a fourth gear, and a fifth gear. The controller is coupled to the first shaft and the first gear is coupled to the first shaft. The first gear is positioned to drive the second gear and the second gear is coupled to a first end of the second shaft. The second end of the second shaft is coupled with the third gear and the third gear is positioned to drive the fourth gear. The fourth gear is coupled to the third shaft and a second end of the third shaft is coupled with a fifth gear. The fifth gear is positioned to adjust the position of the door.

In an embodiment of the present invention, each said first gear, said second gear, said third gear, and said fourth gear are bevel gears. Each drive mechanism further includes a rack configured to be positioned on the door to engage each fifth gear.

In an embodiment of the present invention, each drive mechanism includes a first shaft, a second shaft, a third shaft, a first sprocket, a second sprocket, a roller chain, a first gear, a second gear and a third gear. The controller is coupled to the first shaft and the second shaft is rotatably coupled to the arm. The first sprocket is coupled to the first shaft and is coupled with the second sprocket by the roller chain. The second sprocket is coupled to the second shaft and the first gear is coupled to the second shaft. The first gear is positioned to drive the second gear and the second gear is coupled to the third shaft. The third gear is coupled with the third shaft and positioned to adjust the position of the door. Each said drive mechanism further includes a rack configured to be positioned on the door to engage the third gear.

In an embodiment of the present invention, the base is positioned such that at least a portion of it intersects an axis extending upwardly from the door. The door control assemblies may be positioned on opposite sides of the axis.

In an embodiment of the present invention, a width of the base is approximately equal to a width of the door and the door control assemblies are at opposite ends of the base. The lateral spacing between the door control assemblies may be at least three feet.

DETAILED DESCRIPTION OF THE PRESENT INVENTION

While the present invention may be embodied in many different forms, a number of illustrative embodiments are described herein with the understanding that the present disclosure is to be considered as providing examples and not intended to limit the invention to the preferred embodiments described and/or illustrated herein.

Figure 1:
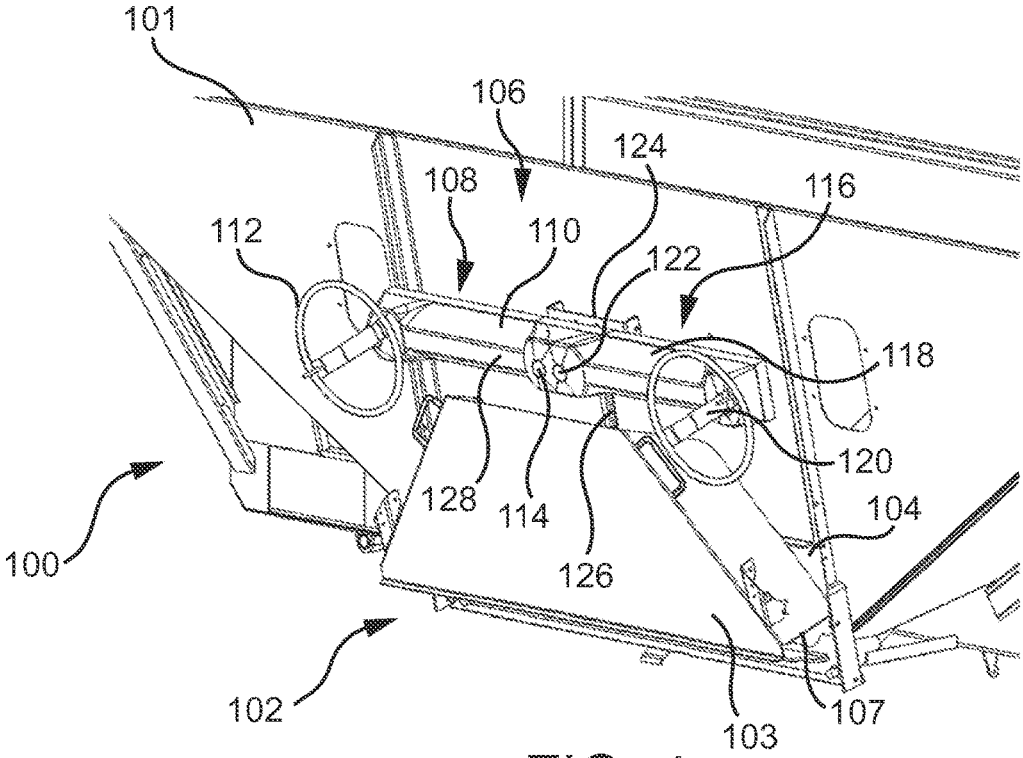
FIG. 1 illustrates a perspective view of a farm implement having a dual door control assembly according to an embodiment of the present invention.
Figure 2:
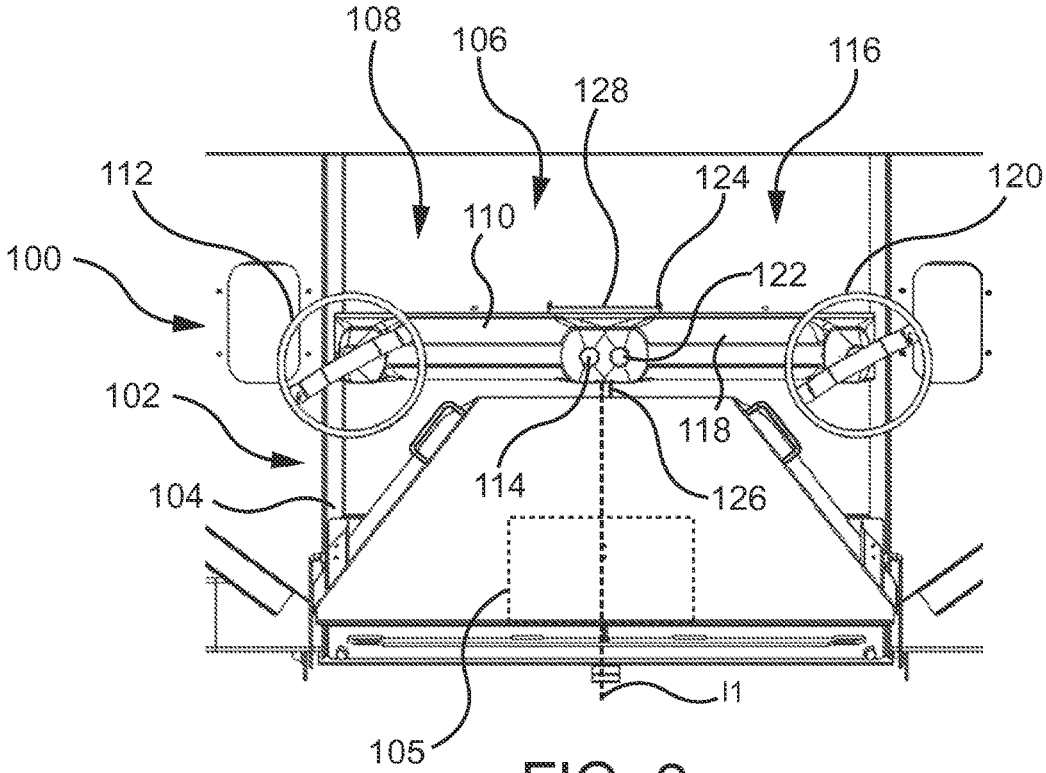
FIG. 2 illustrates a side view of a farm implement having a dual door control assembly according to an embodiment of the present invention.

FIGS. 1 and 2 illustrate a dual position door control 106 for a farm implement 100 according to an embodiment of the present invention. The farm implement 100 shown in FIGS.

1 and 2 is a gravity wagon for transporting grain or the like; however, the dual position door control can be used on any type of farm implement having a door or gate. The farm implement 100 in FIGS. 1 and 2 includes a bin or container 101 including a discharge point 102 with a foldable discharge chute 103 shown in a folded position against the container over an opening (shown by phantom lines at 105) formed through a wall of the container. The opening 105 may be larger than the phantom lines, e.g., the opening may be wider or taller, and is only limited by the size of the opening. The chute 103 is rotatable about a pivot axis 107 along a lower edge of the chute between the folded position shown and an unfolded or deployed position extending downwardly in relation to the opening 105. A door or gate 104 is shown behind the folded chute 103 in a closed position extending across the opening 105 and is moveable between the closed position, in which the door 104 covers the opening 105 to prevent material in the container from flowing out of the opening, and an open position, in which the door 104 does not cover the opening 105 and material is allowed to exit the bin via the opening 105 and flow down the chute 103 under the influence of gravity.

The dual position door control assembly 106 is shown coupled to the farm implement 100 via a mounting bracket 124 but can be coupled to the farm implement directly in another embodiment. The door control assembly 106 includes a first door control assembly 108 and a second door control assembly 116 including a base or support 128 connected at or near its midpoint to bracket 124. In another embodiment, the door control assembly can be coupled directly to the farm implement without a bracket. The first door control assembly 108 includes a controller 112 and a drive mechanism 114 on the left side 110 of the base 128, and the second door control assembly 116 includes a controller 120 and a drive mechanism 122 on the right side 118 of the base 128. The base 128 is oriented horizontally above the door 104, and opposite ends of the base are generally aligned with lateral edges of the door or extend beyond the edges of the door. The controllers 112, 120 of the respective door assemblies may be positioned at the ends of the base 128. Preferably, the controllers 112, 120 have a lateral spacing between them of at least an arm length, i.e., three feet. Generally, the base 128 is positioned such that a point on the base 128 between the first and second controllers 112 and 120 intersects a line l1 extending orthogonally and vertically from the discharge opening, and the first door control assembly 108 is positioned on one side of the line l1 and the second door control assembly is positioned on the opposite side of the line l1. In this configuration, the flow of material discharged from the container 101 will always be between the door control assemblies, and, thus, an operator can control the door assembly from either side without having to walk around the discharge.

The door control assembly 106 further includes a rack 126 that extends vertically downward from the base to connect from the door 104. The controller 112 or 120 and the drive mechanism 114 or 122 can drive the rack 126, which causes the door 104 to move up and down, according to any of the methods described above. The door control assembly further includes a cover 130 and 132 that encloses the drive mechanisms 114 and 122 to prevent foreign objects and debris from interfering with operation of the drive mechanism, and to prevent an operators hands, fingers or clothing from becoming entangled in the mechanism. The drive mechanism 114 and 122 will be discussed in further detail below with reference to FIGS. 3-5, in which the cover is removed.

Figure 3:
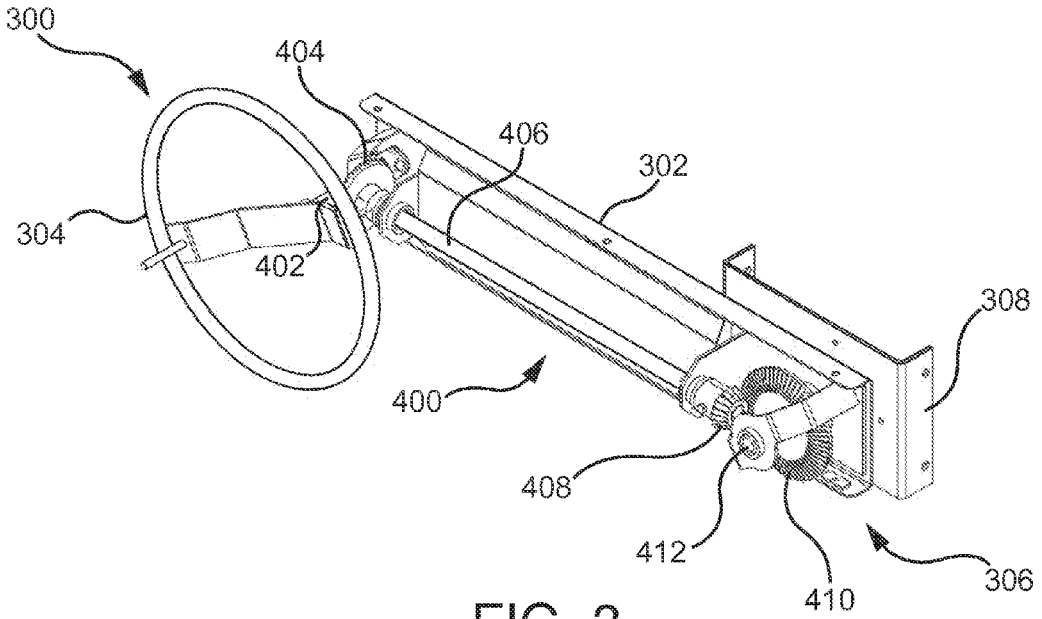
FIG. 3 illustrates a partial perspective view of one side of a dual door control assembly according to an embodiment of the present invention.
Figure 4:
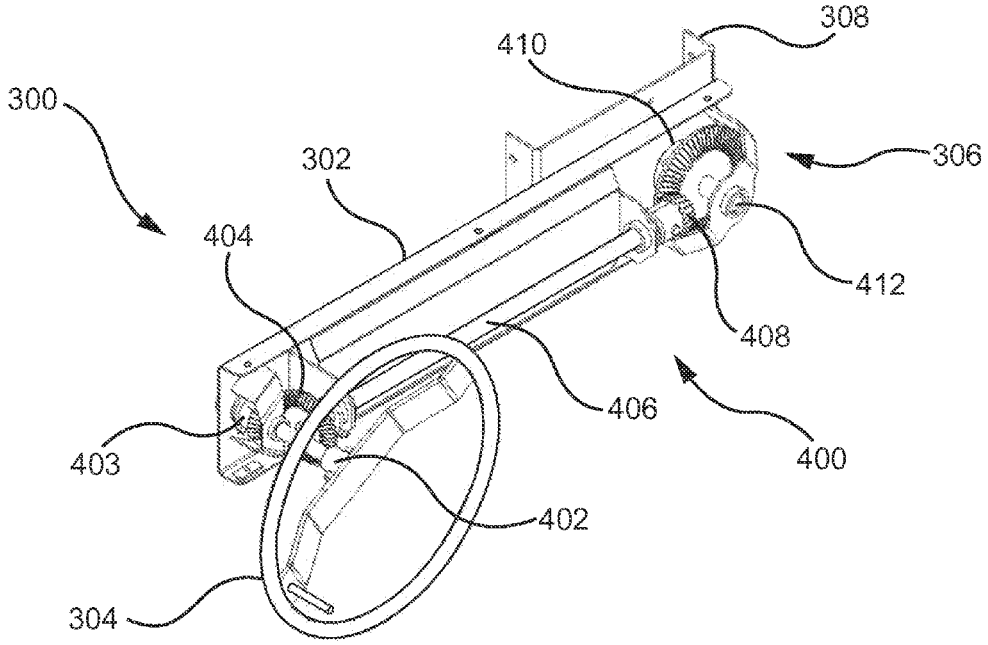
FIG. 4 illustrates a partial perspective view of one side of a dual door control assembly according to an embodiment of the present invention.

FIGS. 3 and 4 illustrate a perspective view of an exemplary drive mechanism 306 for a door control assembly 300 according to an embodiment of the present invention. The door control assembly 300 shown in FIGS. 3 and 4 can be used for the first door control assembly 108, the second door control assembly 116, or both, in the door control assembly 106 shown in FIGS. 1 and 2. The door control assembly 300 includes an elongate base 302 upon which a controller 304 and a drive mechanism 306 are mounted. The drive mechanism 306 is shown as a beveled gear assembly 400. The beveled gear assembly 400 includes a number of drive shafts (402, 406 and 412) oriented perpendicular to one another and carrying beveled gears (403, 404, 408, 410) that mate in order to transmit rotational forces from one shaft to the next. The first shaft 402 extends from the controller 304 toward the bin along an axis of rotation that is perpendicular to the base 302 of the door control assembly. The first shaft 402 is fixed to the controller 304 so as to rotate with the controller. The controller 304 may be a hand operable controller, such as a hand wheel. The first gear 403 is fixed to the other end of the first shaft 402. The first shaft 402 is rotatably coupled to the base 302 such that when the controller 304 is moved the first shaft 402 and the first gear 403 also rotate. The second gear 404 and third gear 408 are mounted at opposite ends of the second shaft 406, which extends perpendicular to the first shaft 402 and parallel to the base 302. The second gear 404 is positioned such that it is driven by the first gear 403 and any rotation of the first gear 403 is transferred to the second gear 404. The first gear 403 and the second gear 404 are preferably beveled gears with gear teeth positioned to engage the teeth of the mating gear. In an embodiment of the present invention, the axis of rotation of the first gear 403 can be approximately perpendicular to the axis of rotation of the second gear 404. In an embodiment of the present invention, the second gear 404 is larger than the first gear 403 to provide less than one rotation of the second gear 404 in response to one rotation of the first gear 403 (i.e., increased mechanical advantage). The second gear 404 is fixed to the second shaft 406 such that the second shaft 406 rotates with the second gear 404. The third gear 408 is fixed to the second shaft 406 such that the motion of the second gear 404 is transferred to the third gear 408.

The fourth gear 410 and a fifth gear (such as the gears engaging the rack in FIGS. 6-11) are disposed at opposite ends of the third shaft 412, which is oriented perpendicular to the second shaft 106. The fourth gear 410 is positioned to be driven by the third gear 408 and any motion of the third gear 408 is transferred to the fourth gear 410. The third gear 408 and the fourth gear 410 are preferably beveled gears with teeth positioned to engage the teeth of the other gear. In an embodiment of the present invention, the axis of rotation of the third gear 408 can be approximately perpendicular to the axis of rotation of the fourth gear 410. In an embodiment of the present invention, the fourth gear 410 is larger than the third gear 408 to provide less than one rotation of the fourth gear 410 in response to one rotation of the third gear 408 (i.e., increased mechanical advantage). The fourth gear 410 is fixed to the third shaft 412 such that the third shaft 412 rotates with the fourth gear 410. The fifth gear is positioned to drive the rack 126 linearly in up and down directions (i.e., vertically), which causes the door 104 to move up or down. The fifth gear is fixed to the third shaft 412 and the motion of the fourth gear 410 is transferred to the fifth gear. In an embodiment of the present invention, the fifth gear is an approximately circular disc-like member including a plurality of teeth about a circumference thereof and the rack 126 is an elongated member that includes a plurality of teeth arranged in a linear manner. The fifth gear and the rack 126 are positioned such that the teeth of the fifth gear engage the teeth of the rack 126.

In an embodiment, the same type of drive mechanism is used on both sides of the door control assembly 106. If a beveled drive mechanism 400 is used, a single fourth gear 410 can be used for both drive mechanisms (i.e, fourth gear is part of both mechanisms), which in turn would cause both controllers to move together. This provides an additional advantage of allowing two operations to control the door in the event of the door sticking or becoming jammed. These embodiments will be discussed in further detail below with respect to the door control assemblies illustrated in FIGS. 6-10.

In use, an operator may adjust the position of the door with either controller 304 by rotating the controller. As the controller 304 is rotated, the first shaft 402 and the first gear 403 rotate with the controller 304 about the same axis of rotation, and the first gear 403 engages and rotates the second gear 404. The rotation of the second gear 404 causes the second shaft 406 and the third gear 408 to rotate about the same axis of rotation as the second gear 404. The third gear 408 engages and rotates the fourth gear 410, and its rotation causes the third shaft 412 and the fifth gear to rotate about the same axis of rotation as the fourth gear 410. The fifth gear engages the rack 126 and can move it up or down, which causes the door 104 to open or close. This operation may be performed with either controller 112 or 120 in the door control assembly 106.

Figure 5:
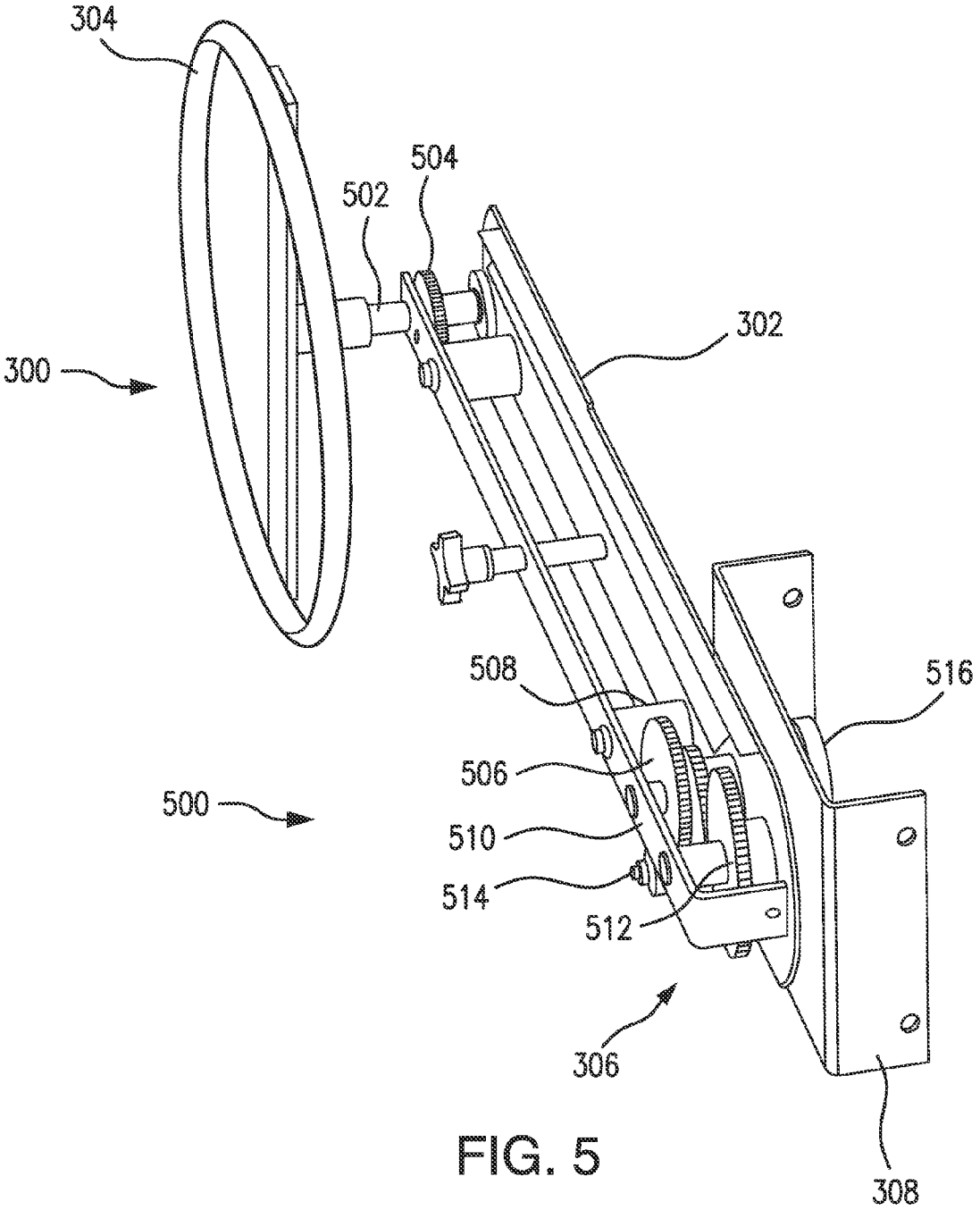
FIG. 5 illustrates a partial perspective view of one side of a dual door control assembly according to an embodiment of the present invention.

FIG. 5 illustrates a perspective view of another door control assembly according to an embodiment of the present invention. The door control assembly 300 is a gear and sprocket assembly 500 which includes a controller 304, a first shaft 502 and a first sprocket 504. The controller 304 is coupled to an end of the first shaft 502 and the first sprocket 504 is fixed to the first shaft 502. The first shaft 502 is rotatably coupled to an end of the arm 302 such that when the controller 304 is moved the first shaft 502 and the first sprocket 504 rotate. The gear and sprocket assembly 500 also includes a second shaft 508, a second sprocket 506 and a first gear 510. The first sprocket 504 is coupled with the second sprocket 506 such that any rotation of the first sprocket 504 is transferred to the second sprocket 506. The second sprocket 506 is fixed to the second shaft 508 such that any rotation of the second sprocket 506 is transferred to the second shaft 508. In an embodiment of the present invention, the first sprocket 504 is coupled to the second sprocket 506 by a roller chain. The first sprocket 504 and the second sprocket 506 can be approximately circular disc-like members with a plurality of protrusions or teeth about a circumference thereof configured to couple with the roller chain. In an embodiment of the present invention, the second sprocket 506 is smaller than the first sprocket 504 to provide more than one rotation of the second sprocket 506 in response to one rotation of the first sprocket 504 (i.e., faster door movement). The first gear 510 is fixed to the second shaft 508 such that it rotates with the shaft 508. Alternatively, the first and second sprockets can be the same size, or the first sprocket 504 can be smaller than the second sprocket 506 to provide slower door movement but increased mechanical advantage.

In the embodiment shown, the gear and sprocket assembly 500 includes a third shaft 514, a second gear 512, and a third gear 516. The second gear 512 is engaged with the first gear 510 such that as the first gear 510 rotates it drives the second gear 512. In an embodiment of the present invention, the first gear 510 and the second gear 512 each include a plurality of teeth and the gears are positioned such that teeth in the first gear 510 engage teeth in the second gear 512. In an embodiment of the present invention, the second gear 512 is larger than the first gear 510. The second gear 512 is fixed to the third shaft 514 such that the rotation of the second gear 512 causes the third shaft 514 to rotate. The third shaft 514 is positioned such that it passes through the mounting bracket 308. The third gear 516 is fixed to the third shaft 514 and positioned between the mounting bracket 308 and a wall of the farm implement 100. The third gear 516 is configured to engage the rack 126 and the rotation of the third gear 516 drives the rack 126, which causes the door 104 to move up or down. In an embodiment of the present invention, the third gear 516 is an approximately circular disc-like member including a plurality of teeth about a circumference thereof and the rack 126 is an elongated member that includes a plurality of teeth arranged in a linear manner. The third gear 516 and the rack 126 are positioned such that the teeth of the third gear 516 engage the teeth of the rack 126.

Figure 6:
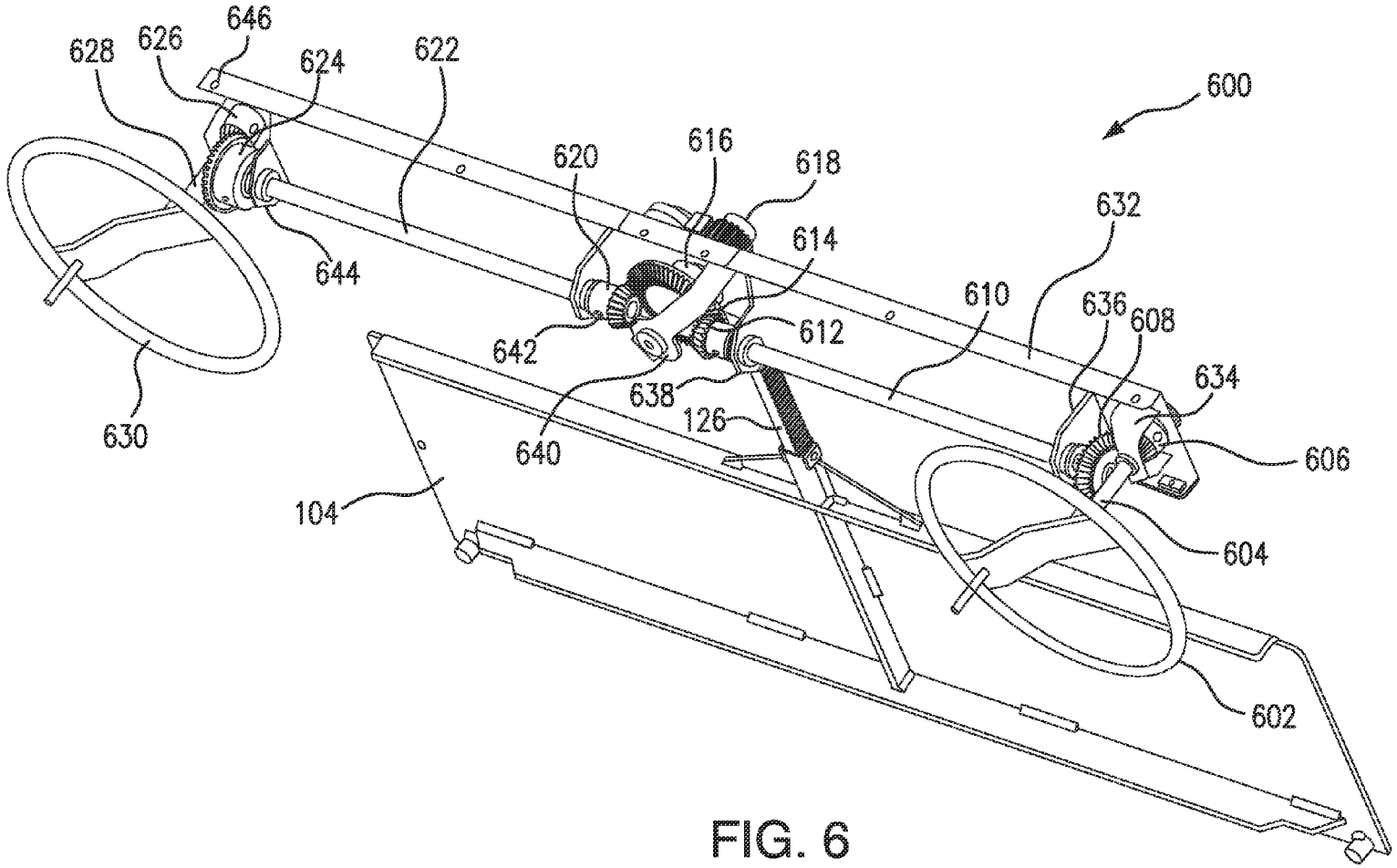
FIGS. 6, 7 and 8 illustrate perspective views of a dual door control assembly according to another embodiment of the present invention.
Figure 7:
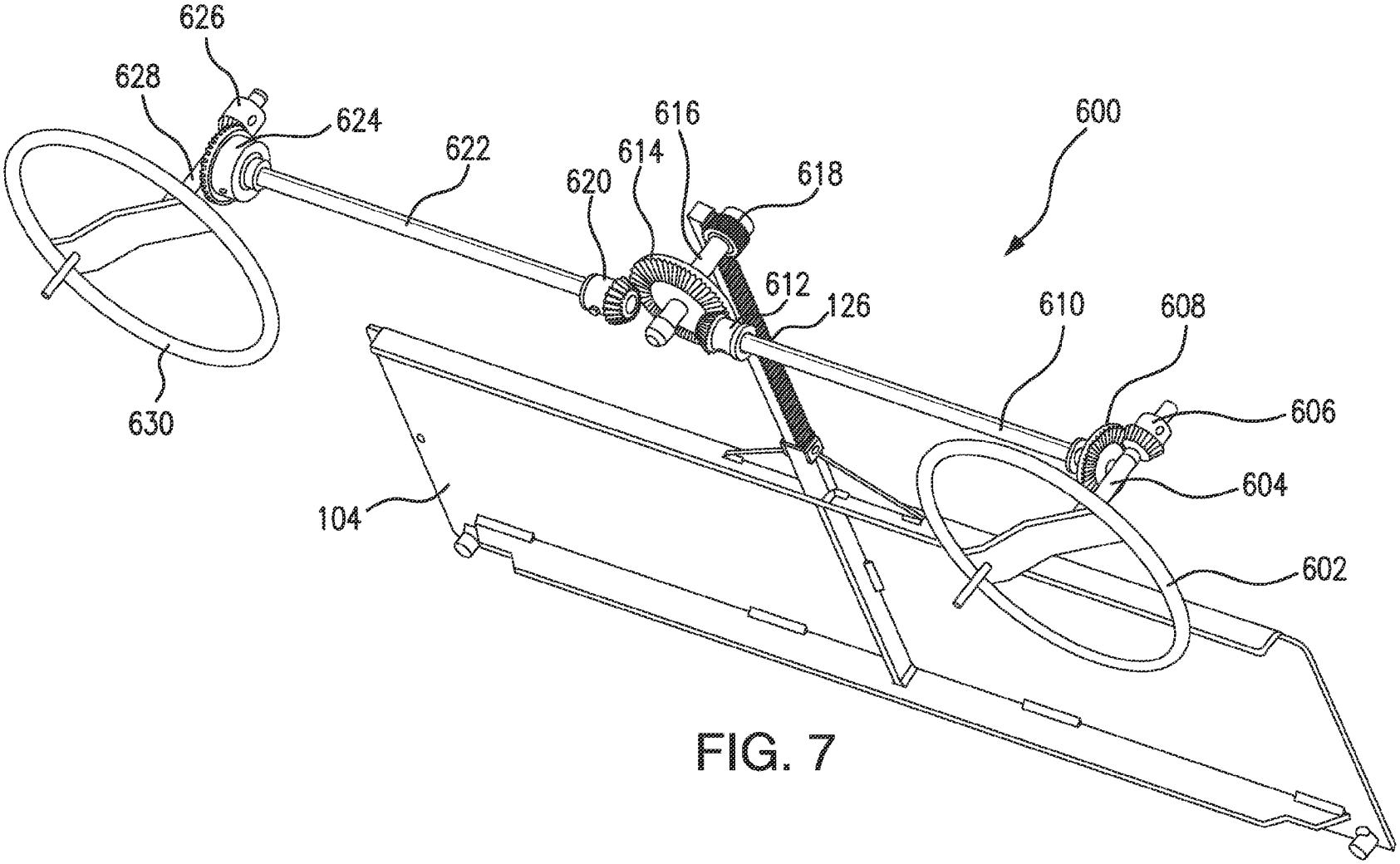
Figure 8:
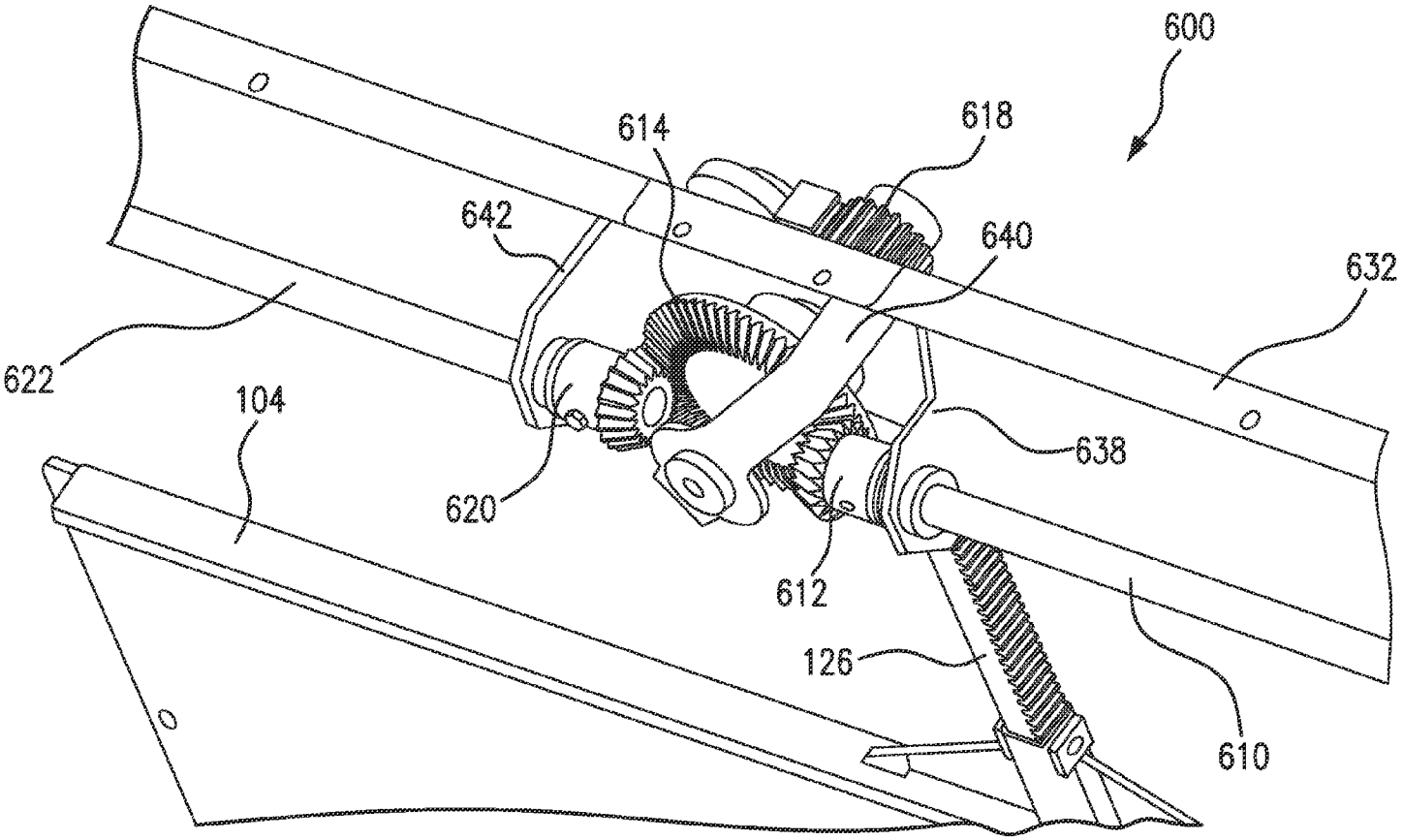

FIGS. 6-8 illustrate another door control assembly according to an embodiment of the present invention. The door control assembly 600 includes a series of beveled gears and shafts to drive a gear engaged with the rack of the door. The door control assembly includes a first controller 602, such as a hand wheel, at a first end coupled to a first shaft 604. The first shaft 604 is coupled to a first gear 606, and the first shaft 604 is configured to translate motion in the first controller 602 to the first gear 606. The first gear 606 is a beveled gear engaged with the second gear 608, which is also a beveled gear. The second gear 608 is coupled to a first end of the second shaft 610, and a third gear 612 is coupled to a second end of the second shaft 610. When the first controller 602 is moved, the first gear 606 drives the second gear 608 and the second shaft 610 translates the movement to the third gear 612. The third gear 612 is a beveled gear engaged with the fourth gear 614, which is also a beveled gear, at a first position. The fourth gear 614 is coupled to a third shaft 616 at a first end, and a fifth gear 618 is coupled to the third shaft 616 at a second end. The fifth gear 618 engages the rack 126, which is coupled to the door 104. The fourth gear 614 may be driven by the third gear 612, and the third shaft 616 translates the motion of the fourth gear 614 to the fifth gear 616. The fifth gear 616 engages the rack 126 to move the door 104 into a closed or open position.

The fourth gear 614 engages a sixth gear 620 at a second position. The second position may be approximately opposite the first position relative to the fourth gear 614. In another embodiment, the second position may be anywhere on the fourth gear 614 relative to the first position. The sixth gear 620 is connected to a second controller 630 through a series of shafts and gears which approximately mirror the gears and shafts connecting the first controller 602 to the third gear 612. The sixth gear 620 is connected to a fourth shaft 622 at a first end, and a seventh gear 624 is connected to the fourth shaft at a second end. The seventh gear 624 is a beveled gear engaged with the eighth gear 626, which is also a beveled gear. The eighth gear 626 is coupled to a fifth shaft 628 at a first end, and the second controller 630 is coupled to the fifth shaft 628 at a second end. Movement in the second controller 630 is translated to the eighth gear 626 through the fifth shaft 628, and the eighth gear 626 drives the seventh gear 624. The seventh gear 624 rotates the fourth shaft 622, which translates the motion to the sixth gear 620. The sixth gear 620 engages the fourth gear 614, which, as discussed above, drives the fifth gear 618 and causes the door to move between open and closed positions.

The drive mechanism is configured such that the first controller 602 and the second controller 630 rotate in the same direction. In operation, two operators may operate the door control assembly by rotating each controller respectively in the same direction.

FIGS. 6 and 8 illustrate a base 632 of the door controller assembly 600. The base 632 may include a cover (as shown in FIGS. 1 and 2) to protect the gears from damage and the elements as well as prevent operators from being injured by the door control assembly while it is in motion. The base 632 may include a series of supports for each shaft. Specifically, it may include a first shaft support 634; first and second second shaft supports 636 and 638; a third shaft support 640; first and second fourth shaft supports 642 and 644; and a fifth shaft support 646. The shaft supports are configured to maintain the shafts in the desired position while allowing the shafts to rotate freely. The base 632 may be coupled to the farm implement 100 directly or by a bracket 124, as shown in FIGS. 1 and 2.

Figure 9:
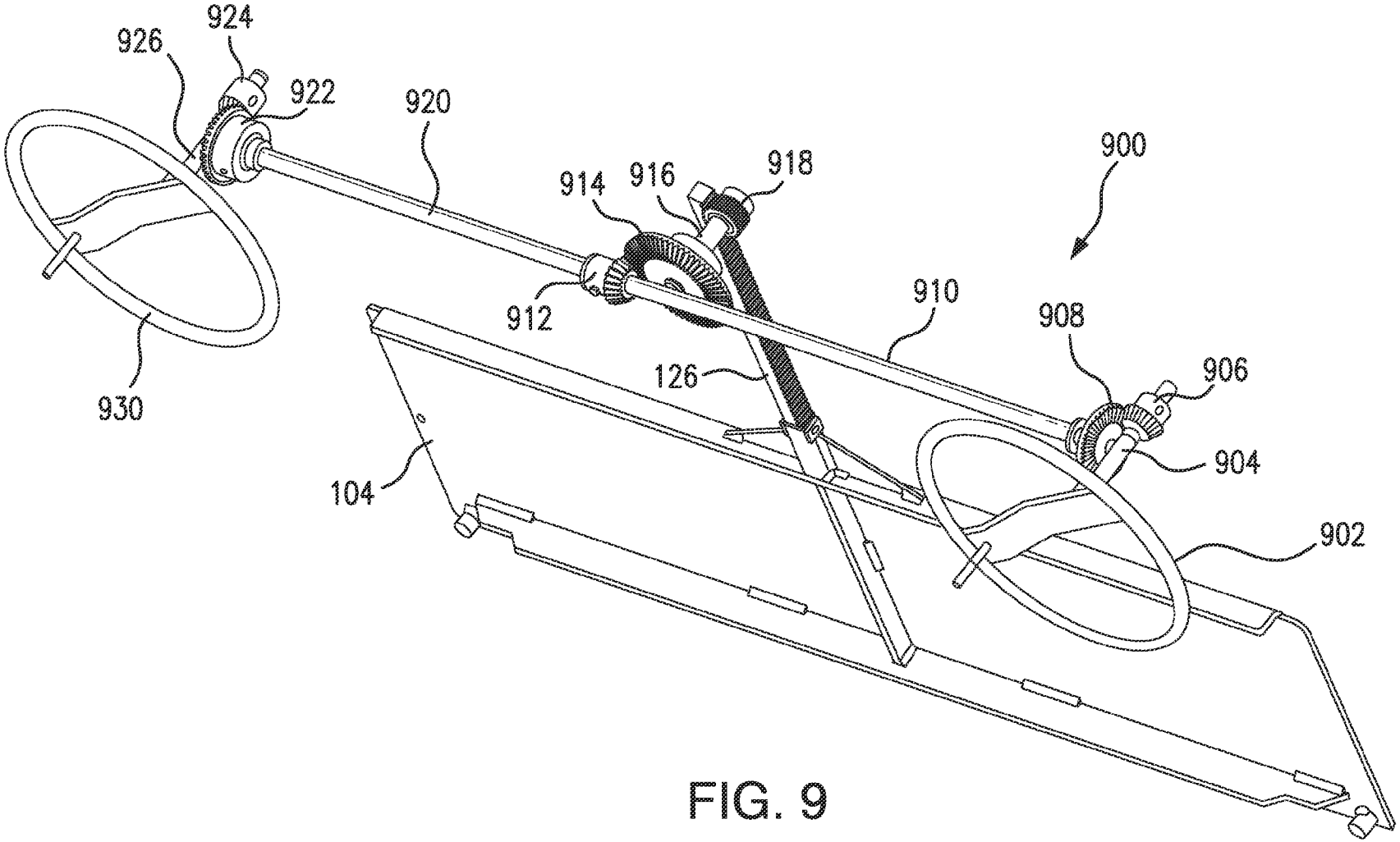
FIGS. 9 and 10 illustrate perspective views of a dual door control assembly according to another embodiment of the present invention.
Figure 10:
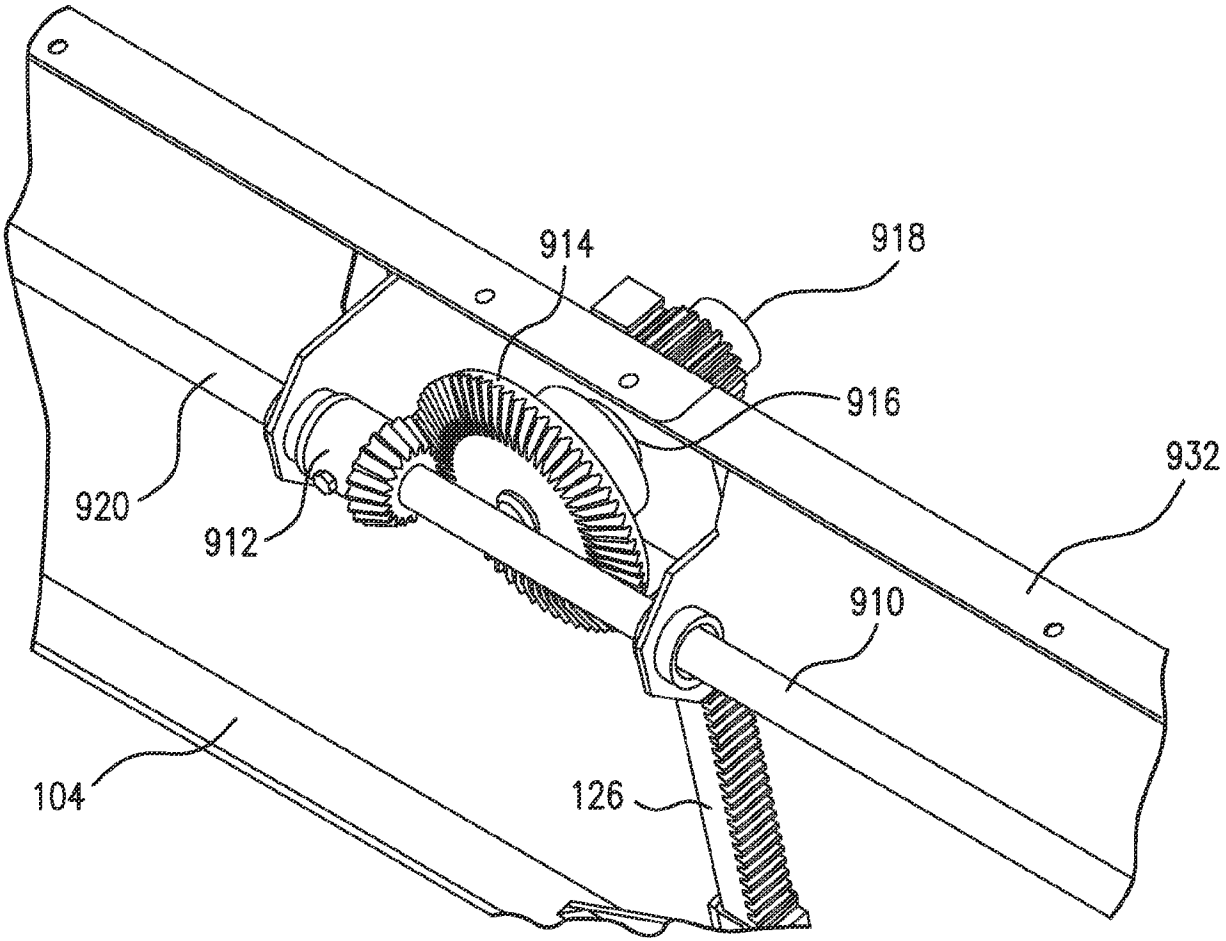

FIGS. 9-10 illustrate another door control assembly according to an embodiment of the present invention. The door control assembly 900 in this embodiment includes a single beveled gear engaged with the gear and shaft arrangement that controls the door. The door control assembly 900 includes a first controller 902, such as a hand wheel, coupled to a first shaft 904 at a first end. A first gear 906 is coupled to the first shaft 904 at a second end, and movement of the first controller 902 is translated to the first gear 906 via the first shaft 902. The first gear 906 is a beveled gear that engages the second gear 908, which is also beveled gear. The second gear 908 is coupled to a first end of a second shaft 910, and a third gear 912 is coupled to a second position of the second shaft 910. The third gear 912 is positioned to engage a fourth gear 914, which engages a third shaft 916 and a fifth gear 918 in a similar manner to the third gear 612, fourth gear 614, third shaft 616 and fifth gear 618 in the embodiment described above.

The third gear 912 is also coupled to a fourth shaft 920. The fourth shaft 920 may be a separate shaft coupled to the opposite end of the third gear 912 to which the second shaft 910 is coupled. In an embodiment of the present invention, the fourth shaft 920 may be a second part of the second shaft 910. The fourth shaft 920 is configured to rotate with the second shaft 910 and third gear 912. A sixth gear 922 is positioned at a second end of the fourth shaft 920, and the rotation of the fourth shaft is translated to the sixth gear 922. The sixth gear 922 is a beveled gear positioned to engage a seventh gear 924, which is also a beveled gear. The seventh gear 924 is coupled to a first end of a fifth shaft 926, and a second controller 930, such as a hand wheel, is coupled to a second end of the fifth shaft 926. The fifth shaft 926 translates motion from the second controller 930 to the seventh gear 924 and visa-versa.

The first controller 902 and the second controller 930 rotate in opposite directions of each other to move the door, i.e., if the first controller is rotated clockwise to move the door into a closed position, the second controller is rotated counterclockwise to move the door into a closed position. Therefore, if two operators cooperate to move the door using the controllers, the operator rotating the first controller 902 must rotate it in the opposite direction the other operator is rotating the second controller 930.

From the above it will be appreciated that the dual position door control of the present invention allows the door of a farm implement to be opened from at least two positions. It will also be appreciated that various changes can be made to the system without departing from the spirit and scope of the appended claims. For example, while a hand wheel is shown for operating the door, other types of hand-operable controllers can be used, such as rotatable hand cranks and movable levers. In addition, drive mechanisms other than chain and sprocket drives can be used, such as belt drives, rack and pinion drives, and/or piston drives. Additionally, the door control system of the present invention can be used on stationary farm implements, such as free-standing storage bins, or mobile farm implements, such as grain wagons, seed tenders, and the like. Also, more than two arms may be used to mount the door control assembly in more than two positions simultaneously. These and other modifications are intended to be encompassed by the appended claims.

We claim:

1. A door control system for a farm implement with a storage bin having a discharge opening and a door movable between open and closed positions relative to the discharge opening, comprising:

a base configured for mounting on the farm implement in relation to the door;

at least two door control assemblies coupled to said base and configured to move the door between open and closed positions;

each door control assembly including:

a controller coupled to the base and movable in relation thereto;

a drive mechanism coupled with the controller and configured to move the door between the open position and the closed position in response to movement of the controller.

2. The system of claim 1, wherein each said controller includes a hand wheel.

3. The system of claim 1, wherein said base is positioned such that at least a portion of it intersects an axis extending upwardly from the door.

4. The system of claim 3, wherein the door control assemblies are positioned on opposite sides of the axis.

5. The system of claim 1, wherein a width of the base is approximately equal to a width of the door and the door control assemblies are at opposite ends of the base.

6. The system of claim 5, wherein a lateral spacing between the door control assemblies is at least three feet.

7. The system of claim 1, wherein each of said controllers is in a line parallel to a horizontal axis of said door.

8. The system of claim 1, wherein each of said door control assemblies is positioned above said door.

9. The system of claim 1, wherein a position of the base relative to the farm implement is configured to be fixed as the door is moved between the open position and the closed position in response to movement of the controller.

10. The system of claim 1, wherein each drive mechanism is configured to move the door up until it reaches the open position or down until it reaches the closed position in response to movement of the controller.

11. The system of claim 1, wherein each drive mechanism is configured to move the door between the open position and the closed position in response to movement of the corresponding controller independently of movement of each other controller.

12. The system of claim 1, wherein the door control assemblies are at opposite ends of the base.

13. A door control system for a farm implement with a storage bin having a discharge opening and a door movable between open and closed positions relative to the discharge opening, comprising:

a base configured for mounting on the farm implement in relation to the door;

at least two door control assemblies coupled to said base and configured to move the door between open and closed positions;

each door control assembly including:

a controller coupled to the base and movable in relation thereto;

a drive mechanism coupled with the controller and configured to move the door between the open position and the closed position in response to movement of the controller, wherein each said drive mechanism includes a first shaft, a first gear, a second shaft, a second gear, a third gear, a third shaft, a fourth gear, and a fifth gear wherein:

said controller is coupled to the first shaft and said first gear is coupled to said first shaft, said first gear is positioned to drive said second gear and said second gear is coupled to a first end of said second shaft, a second end of said second shaft is coupled with said third gear and said third gear is positioned to drive said fourth gear, said fourth gear is coupled to said third shaft and a second end of said third shaft is coupled with a fifth gear, said fifth gear is positioned to adjust the position of the door.

14. The system of claim 13, wherein each said first gear, said second gear, said third gear, and said fourth gear are bevel gears.

15. The system of claim 13, wherein each said drive mechanism further includes a rack configured to be positioned on said door to engage each said fifth gear.

16. The system of claim 1, wherein each said drive mechanism includes a first shaft, a second shaft, a third shaft, a first sprocket, a second sprocket, a roller chain, a first gear, a second gear and a third gear, wherein: said controller is coupled to said first shaft and said second shaft is rotatably coupled to said arm, said first sprocket is coupled to said first shaft and is coupled with said second sprocket by said roller chain, said second sprocket is coupled to said second shaft and said first gear is coupled to said second shaft, said first gear is positioned to drive said second gear and said second gear is coupled to said third shaft, and said third gear is coupled with said third shaft and positioned to adjust the position of the door.

17. The system of claim 16, wherein each said drive mechanism further includes a rack configured to be positioned on said door to engage said third gear.

* * * * *